United States Patent [19]

McMath

[11] 4,245,411

[45] Jan. 20, 1981

[54] MANUAL SCOOP TYPE SNOW PUSHER/LIFTER

[76] Inventor: Edward W. McMath, 4305 Ridge Rd., Baltimore, Md. 21236

[21] Appl. No.: 50,068

[22] Filed: Jun. 19, 1979

[51] Int. Cl.[3] ..... E01H 5/02

[52] U.S. Cl. ..... 37/53; 294/54; 294/55

[58] Field of Search ..... 37/53; 294/49, 54, 55, 294/57; 15/257.1, 257.7, 257.8, 257.9

[56] References Cited

U.S. PATENT DOCUMENTS

| | | | |
|---|---|---|---|
| D. 233,158 | 10/1974 | Lowe, Jr. | D30/99 |
| 557,988 | 4/1896 | Gageby | 294/49 |
| 1,519,718 | 12/1924 | Blair | 37/53 |
| 1,678,135 | 7/1928 | Crosman et al. | 37/53 |
| 2,891,330 | 6/1959 | Murphy | 37/53 |
| 3,106,303 | 10/1963 | Finocchiaro | 294/55 X |
| 3,440,741 | 4/1969 | Yates | 37/53 |
| 3,475,838 | 11/1969 | Hagen et al. | 37/53 |
| 3,893,248 | 7/1975 | Young | 37/53 X |
| 4,067,107 | 1/1978 | Scafetta | 37/53 X |
| 4,125,951 | 11/1978 | Huerth | 37/53 |

FOREIGN PATENT DOCUMENTS

| | | | |
|---|---|---|---|
| 80363 | 3/1895 | Fed. Rep. of Germany | 37/53 |

*Primary Examiner*—Steven A. Bratlie
*Attorney, Agent, or Firm*—John F. McClellan, Sr.

[57] ABSTRACT

An improved scoop type snow scraper/lifter has a length to reach at substantially a 45° angle from the ground to the user's hip level, a symmetrical trapezoidal shape with faired-in handgrips at the transverse upper end spaced apart at nominal human hip spacing, these critical dimensions coact with the structure to permit substantially strain-free pushing and scooping of snow by leaning or bumping urging of the unit with the hips which are cushioned by the hands on the handgrips and substantially strain-free lifting of snow scooped, by pivoting the unit on one knee and pressing down on the handgrips to raise the snow and pivot it aside; tapered construction and a spaced pair of skids make the unit less likely to cause injury if broken and quieter in operation.

1 Claim, 4 Drawing Figures

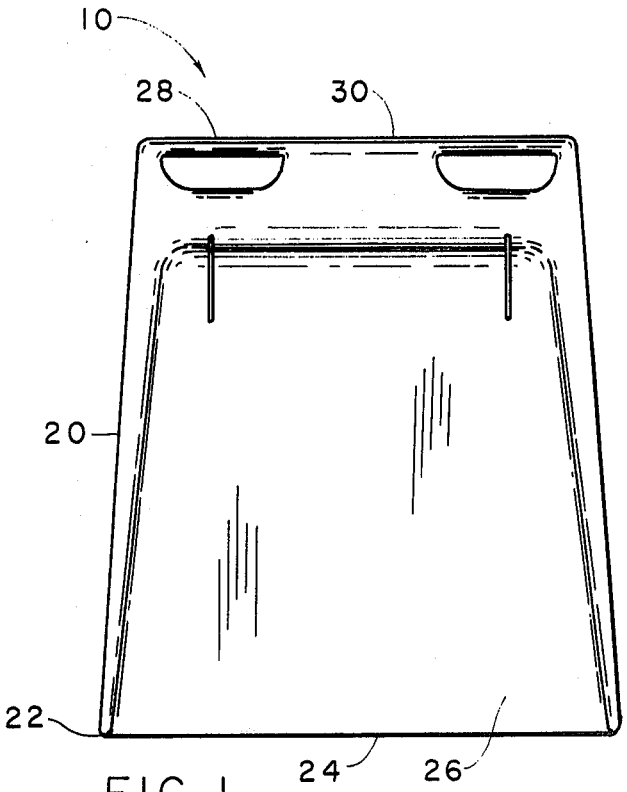
FIG. 1
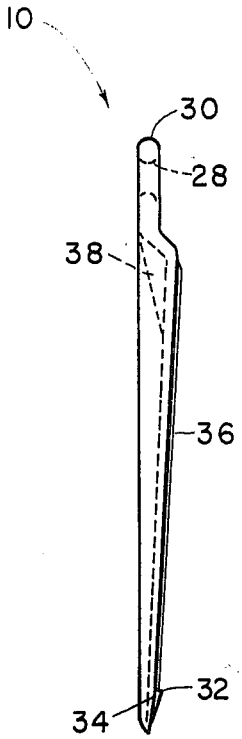
FIG. 2
FIG. 3
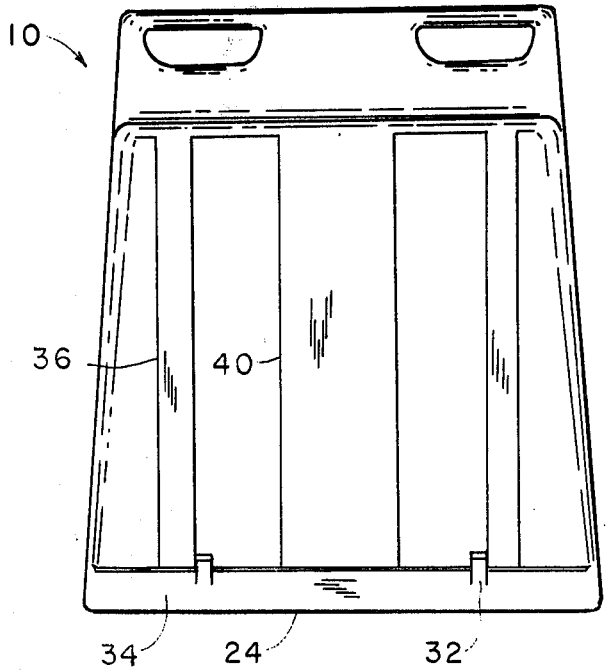
FIG. 4
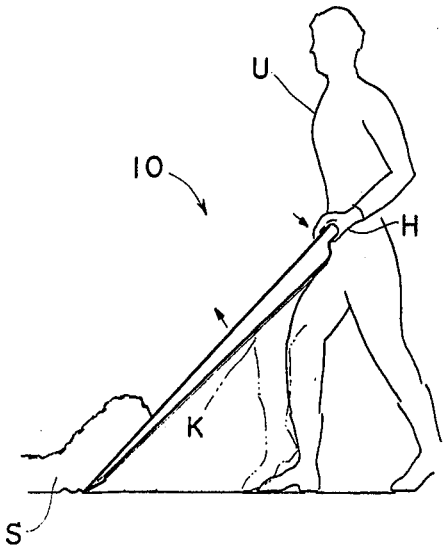

MANUAL SCOOP TYPE SNOW PUSHER/LIFTER

This invention relates generally to material handling and specifically to snow removal equipment.

A principal object of the invention is to provide an improved manual scoop type snow remover or snow pusher/lifter which complements the structure of the human body for movement of snow in a new way.

In the prior art various disclosures of such apparatus have been made, as exemplified by the following U.S. patents:

U.S. Pat. No. 4,125,951 to A. W. Huerth, 11-21-78, discloses a push-type shovel with sides, pan curving to back, longitudinal runners beneath the pan, and a gripping means 39 on the upper edge of the back, by which it could be manipulated if the handle were left unattached.

U.S. Pat. No. 3,475,838 to K. G. Hagen et al, 11-4-69, discloses as a portion of the assembly a "bucket" in the shape of a scoop with bottom rounding into back and having interior longitudinal ribs.

U.S. Pat. No. Des 233,158 to H. E. Lowe, Jr., 10-8-74, discloses a unitary scoop with a portion at the upper rear which can be grasped as a handle.

However, it is believed that none of the devices before available could provide the combination of structure and advantages of the present invention as indicated by the following objects and description.

Further objects are to provide a unitary snow pusher/lifter which protects the user from overexertion and slipping while efficiently removing snow faster than customary manual snow removal equipment, which is easy to learn to use properly, which is adaptable to manufacture in various sizes to suit users of various sizes, which is durable, economical to make and ship, which stores as a flat unit in minimum space, and which is atrractive in appearance.

In brief summary given as cursive description only and not as limitation the invention includes a unitary scoop type snow pusher remover long enough to extend at snow scooping angle from the ground to the user's hips, and having faired in handgrips in the transverse upper end spaced for holding positions protective of the user's hips which can thereby be used to thrust the unit forward, and having a flat surface beneath which can bear upon the user's knee used as a fulcrum so that the user merely presses down on the handgrips and pivots the load about his knee to lift it and swing it aside for dumping.

The above objects and advantages of the invention will become more readily apparent upon examination of the following description, including the drawings in which like reference numerals refer to like parts:

FIG. 1 is a front view of the invention shown relatively short for compactness of illustration;

FIG. 2 is a side view thereof;

FIG. 3 is a rear view thereof; and

FIG. 4 shows the invention in use as a snow scraper with one snow lifting mode detail shown in phantom lines.

FIG. 1 shows the invention 10 in front view. Preferably the outline shape is symmetrically trapezoidal with the sides 20 equal in length and each tapering upwardly in height and in thickness from a narrow, low, non-snag, rounded outer corner 22 at the scraping edge 24. The scraping edge is preferably wider than the top. The pan 26 accordingly progressively increases in thickness and narrows in width upwardly, and rounds out into the sides and top to facilitate loading and unloading. According to important provisions of this invention length of the unit is such as to reach at a scooping angle, which may be 30° to 60°, from the surface to be scraped to the nominal level of the hips of the user. This means permits the user to urge the unit along safely by bumping it with the hips or leaning against it with the hips when in snow or ice giving rough and uneven resistance. Most of the time, pushing may be done with the arms with the implement held the length of the forearms in front of the body.

Another important provision is means for automatically interposing the user's hands as cushions between the user's hips and the unit regardless of whether the palms are turned down or up. In this mode also the arms in a sense can act as shock absorbers if a bump on the pavement is hit. A pair of symmetrically laterally spaced perforate handgrips 28, each comprising a rounded cross-sectional shape is faired-in nonprotrusively and uniformly in the transverse top 30 of the unit. Spacing between the handgrip centers or portions grippable is equal to the nominal center spacing between a user's hips, automatically providing this hand cushioning when the unit is gripped. This spacing also provides good twisting purchase for dumping snow when a load is to be thrown to the side.

FIG. 2 shows that the transverse top 30 is rounded in section to protect the user, and that the gripped part of the handgrips 28 is preferably rounded to accommodate the grip equally well with palms up or palms down.

Skids 32 at the bottom which can provide clearance of obstacles and bottom reinforcements 34, 36 are further shown in the next Figure. Gussets 38 may be used to strengthen the connection between top and pan.

FIG. 3 shows details of the back of the unit 10; a reinforcing wedge-section portion 34 extending across the scraping edge 24 stiffens and strengthens it. The pair of laterally spaced apart skids 32 adjacent the scraping edge and extending outwardly therefrom in a rearward direction quiets the scraping action of the unit, inhibits side-slip and minimizes wear on the scraping edge. The symmetrically disposed reinforcing strip 36, 40 thicken the bottom, the pair of narrow strips being laterally spaced to the sides, and the center strip being a planar area broader than the nominal width of a user's knee and long enough for the user's knee to bear on comfortably at any chosen position along the length in levering the load for dumping in the manner indicated below.

FIG. 4 illustrates a user U urging (preferably gently bumping) the invention 10 along with hips H bearing against portions P of the handles, regardless of how turned, according to provisions of the invention, for scooping up a load of snow S. This is similar to urging by tapping with a hammer, as opposed to pressing with bent arms, which reduces forward motion in case an obstacle such as an ice ridge on the pavement suddenly yields. As noted, in smooth going the arms may be used to thrust the implement along.

The phantom lines indicate one mode of raising and dumping the snow safely. One knee K is advanced and raised bent and the handgrips are pressed down, levering the load up, from which point it can be pivoted to the side and dumped by twisting the unit or by raising the handgrips. Either method prevents excess strain on the back and permits lifting a heavy load easily. Thus the most powerful muscles in the body are used in the lifting, the hip flexor and thigh muscles.

As an alternative, the knee may be retracted to reduce the distance to the hands from the point of contact and give clearance to pivot the implement about the knee as a fulcrum.

Depending on snow type and depth a greater or lesser amount of snow may be pushed ahead rather than scooped, other things being equal, but with compaction increasing with length of push.

In actual use with a prototype of this invention in removing fresh snow four inches (0.1 M) deep from a paved driveway removal time was cut twenty minutes from the more than one hour required with a snow-shovel and strain and energy expended were much less.

Material of which the unit is built may be thermoplastic such as polystyrene, molded plywood, or metal, preferably aluminum. Nominal dimensions for a range of user height of 5 feet to 6½ feet (1.5 to 1.9 m) are: overall length, 44 to 48 inches (1.1 to 1.2 m) and center spacing of handgrips, 14 to 16 inches (0.3 to 0.4 m). Scraper width preferably is 36 inches (0.9 m) with top width 30 inches (0.75 m) and maximum height of sides 3 inches (0.075 m). Weight of the unit in plastic may be about three pounds (1.4 kg), and the tapered design facilitates plastic construction.

It will be appreciated that the abdomen may be used to urge the unit with the same general cushioning by the hands. Operating posture of the user can be generally upright, preserving balance, as opposed to the less stable and less safe leaning forward posture often employed in manually pushing implements. Further, because of the lightness of the unitary construction the unit may be held upright for dragging snow off steps and the like. It will be found equally effective in moving powder snow and slush snow.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a scoop-type snow scraper/lifter having a pan with sides tapering in height, handle means, and a transverse scraping edge at the bottom, the improvement comprising: means permitting a user safely to urge the snow scraper/lifter with the user's hips, including: said snow scraper/lifter having length reaching upward at a snow scraping angle from the transverse scraping edge at the lower end to the nominal level of a user's hips from a ground surface to be scraped, a transverse top on the snow scraper/lifter, means for cushioning contact between the transverse top and a user's hips by automatically interposing the user's hands between the transverse top and a user's hips including a pair of laterally spaced transverse handgrips faired-in to the transverse top with a center spacing substantially equal to the nominal center spacing between a user's hips; the back of the pan having therealong a planar central reinforcing portion broader than the nominal width of a user's knee and in position for a user's knee to bear on in pivoting the snow scraper/lifter to lift a load of snow and discharge it to the side; means permitting the handgrips to be grasped comfortably with the hands turned up or down, comprising the handgrips being rounded in shape in cross section; the pan and sides having a taper in thickness increasing from the transverse scraping edge upward to the transverse top; and a pair of laterally spaced skids adjacent the scraping edge and extending outwardly therefrom in a rearward direction.

* * * * *